US005863182A

United States Patent [19]

Hill et al.

[11] Patent Number: 5,863,182

[45] Date of Patent: Jan. 26, 1999

[54] FAN BLADE FLOW ENHANCING DEVICE

[75] Inventors: D. Lee Hill, Olathe, Kans.; Jimmy D. Vanfossan, Gladstone, Mo.; Hamid Massali, Leawood, Kans.

[73] Assignee: Emerson Electric Co., St. Louis, Mo.

[21] Appl. No.: 871,110

[22] Filed: Jun. 9, 1997

[51] Int. Cl.[6] ..... F04D 29/38

[52] U.S. Cl. ..... 416/237; 416/62; 416/210 R

[58] Field of Search ..... 416/62, 146 R, 416/183, 175, 203, 210 R, 228, 235, 237

[56] References Cited

U.S. PATENT DOCUMENTS

| | | | |
|---|---|---|---|
| 1,055,947 | 3/1913 | Schwartzberg . | |
| 2,116,849 | 5/1938 | Rosner . | |
| 2,288,592 | 7/1942 | Mirhige . | |
| 2,801,793 | 8/1957 | Kline | 416/235 |
| 2,990,889 | 7/1961 | Welch . | |
| 3,733,147 | 5/1973 | Felker | 416/210 R |
| 3,812,812 | 5/1974 | Hurwitz . | |
| 4,618,313 | 10/1986 | Mosiewicz . | |
| 4,662,823 | 5/1987 | Cooke . | |
| 4,676,721 | 6/1987 | Hardee . | |
| 4,832,572 | 5/1989 | Prucha et al. . | |
| 4,892,460 | 1/1990 | Volk . | |
| 5,273,399 | 12/1993 | Ojeda . | |
| 5,281,093 | 1/1994 | Sedlak et al. . | |
| 5,328,329 | 7/1994 | Monroe . | |
| 5,370,721 | 12/1994 | Carnahan . | |
| 5,516,264 | 5/1996 | Anetrini . | |

FOREIGN PATENT DOCUMENTS

| | | | |
|---|---|---|---|
| 216297 | 5/1924 | United Kingdom | 416/235 |

*Primary Examiner*—Christopher Verdier
*Attorney, Agent, or Firm*—Shook, Hardy & Bacon L.L.P.

[57] ABSTRACT

An attachment for improving the efficiency of a fluid circulation device such as a fan comprises a back connector portion for connecting to a fan blade and a lobe which protrudes from a leading edge of the fan blade. An impeller has a plurality of fan blades extending from a central hub, and the impeller is rotated by an electrical motor. The impeller is housed within a fan guard. As the impeller is rotated, the lobes operate to pick up air passing around the preceding blade and continue accelerating the air to increase efficiency and flow.

15 Claims, 3 Drawing Sheets

FAN BLADE FLOW ENHANCING DEVICE

BACKGROUND OF THE INVENTION

This invention relates to fluid circulation devices. More specifically, the present invention relates to devices and methods for improving the efficiency of air fans.

Fluid circulation devices are utilized in a variety of domestic, commercial, and industrial applications. Air circulation devices in the form of fans typically comprise impellers made up of a plurality of blades attached to a hub. In commercial and industrial applications where the operational requirements of the fans are high, the blades are typically made with metal to sustain high speeds over extended periods of use. In these commercial and industrial applications, such as automobile plants, fans may be found in great quantity. Because each individual work station will frequently have its own fan, a single plant may use hundreds or possibly thousands of them.

Because of the high number of the devices that are used in commercial and industrial applications, small gains in efficiency have a measurable impact on the overall cost of operating them even in a single plant. Hence, many attempts have been made to increase performance and efficiency which are measured by several factors: output in cubic feet per minute (cfm), overall power consumption, and heat rise of the device.

Attempts to increase efficiency frequently involve altering the shape of the blade. Past attempts at modifying blade shapes have resulted in complex parabolic or hyperbolic blade configurations and complex variations of the pitch at which the blades attack the surrounding air. However, operational blade shapes are limited because the available processes for forming metal blades are not capable of forming certain blade shapes cost effectively, if at all, and developing the tooling for mass production of a new blade shape is costly.

In attempts to overcome some of the costs of modifying blade shapes, separate components have been attached to the blade in attempts to improve efficiency. These attempts typically involve adding an extension to the trailing edge of a blade thereby increasing its surface area and hopefully the efficiency of the air circulation device. Increases in efficiency gained by these previous blade attachments have been small, unsuited for commercial and industrial applications, and, therefore, of minimal significance.

Thus, improvements in fan efficiency are desirable to enhance air flow and to reduce the cost of operation. It is also desirable to obtain such increases in efficiency without modification of existing blade shapes and means for attaching the blades. Increases in efficiency obtained without modifying the actual blade shape or the means for attaching the blades to hubs, reduce the cost of production for fans.

BRIEF SUMMARY OF THE INVENTION

There is, therefore, provided in the practice of the invention a novel impeller blade for attachment to a hub of an air circulation device such as a fan. The blade comprises a generally rectangular blade petal having an inner hub end, an outer free end, a leading edge, and a trailing edge. The blade also has a means for attachment to the hub at or near the inner hub end. To increase efficiency, a lobe is extended from the leading edge of the blade petal.

In a preferred embodiment, the lobe comprises an independent attachment which is attachable to the blade petal at the inner hub end of the blade petal. Generally, the lobe is rounded. More specifically, the lobe comprises a curved protrusion. Because the attachment is positioned on the inward portion of the blade petal, the attachment can conveniently be made of plastic which is less expensive than other materials. Plastic may be used when located inwardly near the hub on the device because of the lower stresses experienced there.

Preferably, the attachment has a back connection portion for connection to the blade petal and a forward extending lobe protruding from the leading edge of the blade petal. The back connection portion connects proximate to the inner hub end of the blade petal and the forward extending lobe protrudes from the leading edge of the blade petal at the inner hub end. Preferably, the back connection portion connects to both the inner hub end of the blade petal and the hub.

Each blade petal of the fan will have a lobe protruding from the leading edge thereof which rearwardly overlaps the blade petal of the preceding blade. The lobe protrudes from the leading edge near the inner hub end of the blade petal and at least a portion of the lobe protrudes radially inwardly from the blade petal to reduce the area of a central opening.

BRIEF DESCRIPTION OF THE DRAWINGS

These and other features, advantages, and objects will appear from the following Detailed Description when considered in connection with the accompanying drawings in which similar reference characters denote similar elements throughout the several views and wherein.

DETAILED DESCRIPTION OF THE PREFERRED EMBODIMENTS

Figure 1:
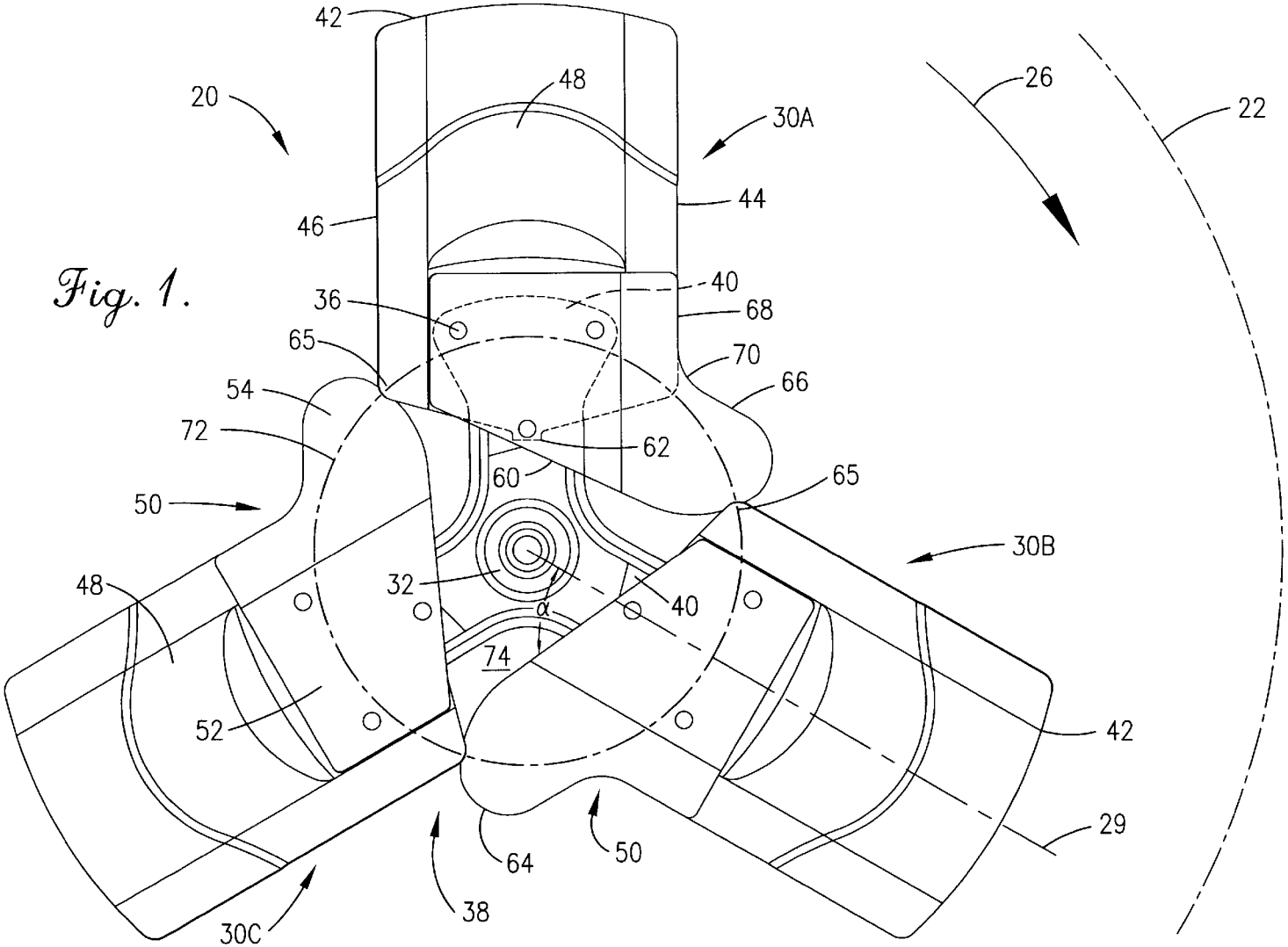
FIG. 1 is a front elevational view of an impeller according to the present invention.
Figure 2:
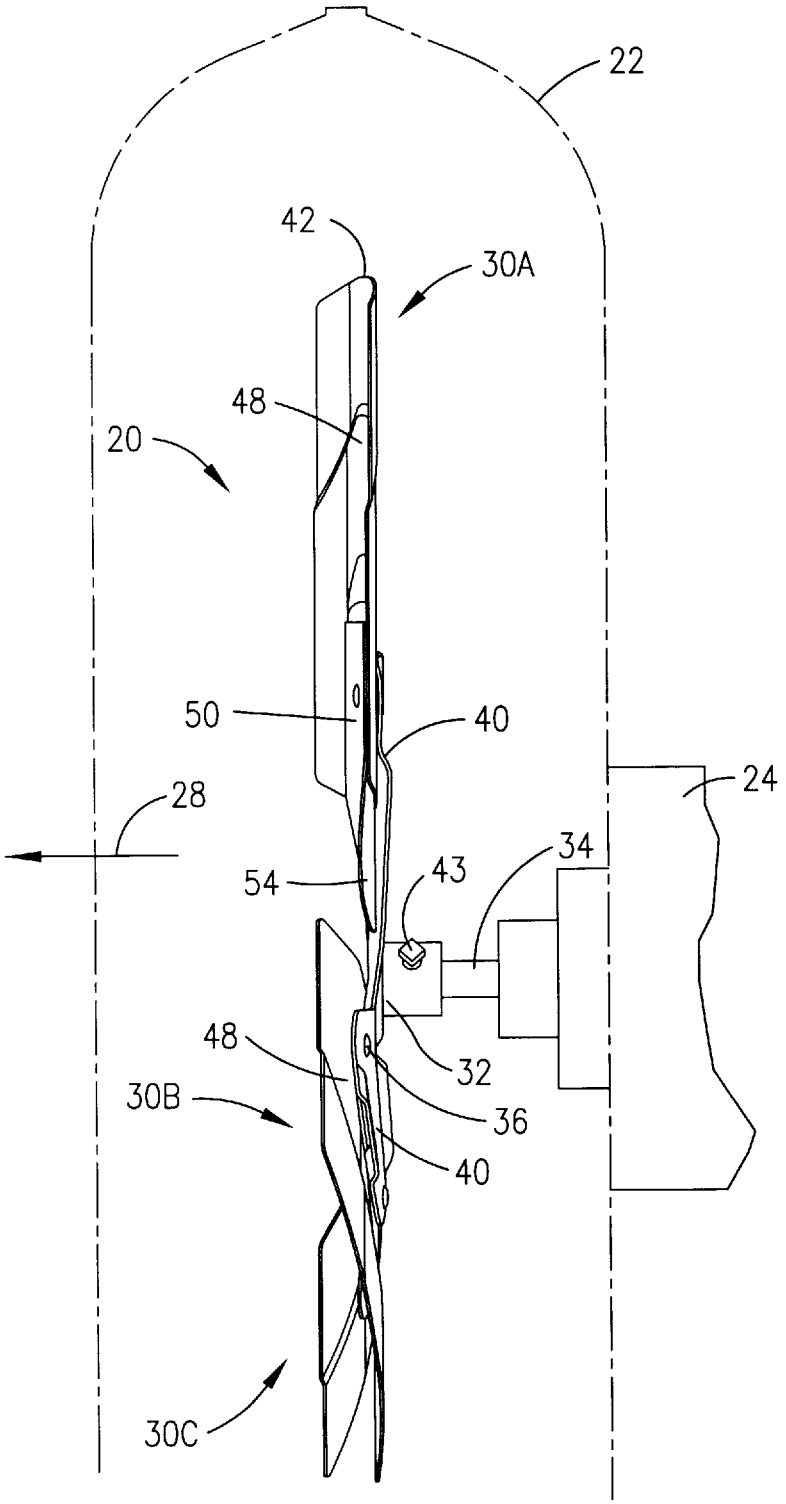
FIG. 2 is a side view of the impeller shown in FIG. 1 and also illustrating other components of a fluid circulation device.

FIGS. 1 and 2 show a fluid circulation device, specifically, a fan for circulating air according to the present invention. The fan comprises an impeller assembly, generally designated 20, surrounded by a fan guard 22. The periphery of the fan guard 22 is shown in phantom lines. The impeller is driven by motor 24 to rotate the impeller in the direction of arrow 26 to create air flow in the direction of arrow 28. The fan as shown includes many conventional features which will be discussed only as necessitated by the description of the present invention.

The impeller comprises a plurality of blades, generally designated 30A, 30B, and 30C which are connected to a central hub 32. The central hub is rotationally fixed to a motor shaft 34 extending from the motor, and thus, the blades are rotationally coupled to the motor by the central hub 32 and the motor shaft 34. The blades are pitched, so that as they rotate they force air in the direction of arrow 28. Three blades are provided in the preferred embodiment shown.

The blades are attached to the central hub with conventional fastening means 36, such as rivets or welds, which attach inner hub ends, generally designated 38, of the blades to wings 40 of the hub. The blades extend radially outward from the hub and terminate with outer free ends 42. The hub 32 is fixed to the motor shaft by a set screw 44 as shown.

Figure 4:
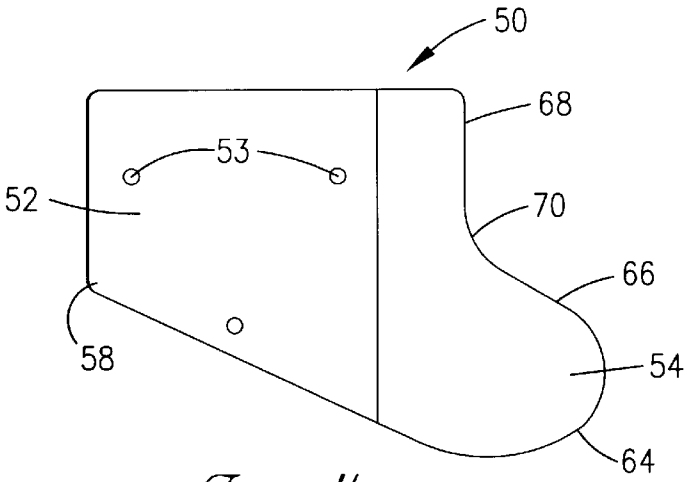
FIG. 4 is a front elevational view of the attachment of FIG. 3.
Figure 3:
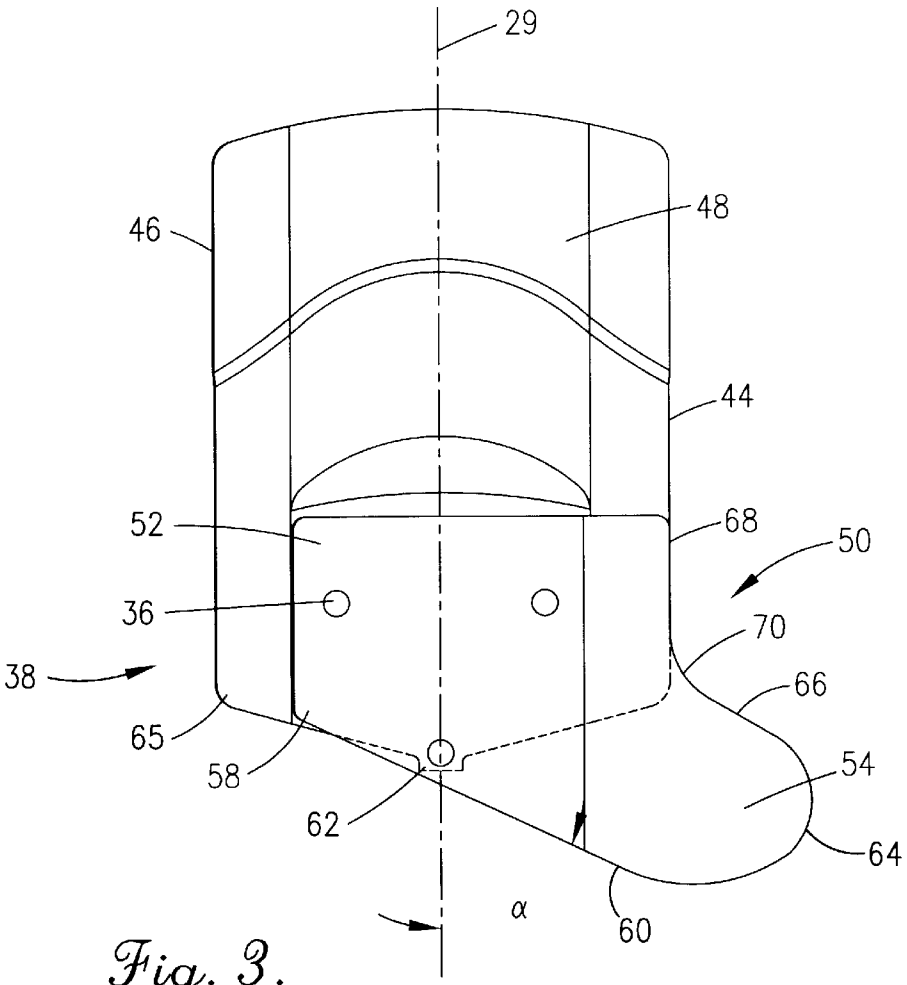
FIG. 3 is a front elevational view of a blade and an attachment from the impeller shown in FIG. 1.

Referring to FIGS. 3 and 4, each blade comprises a generally rectangular blade petal 48. The overall shape or configuration of each blade is modified by connecting an attachment, generally designated 50, to the blade petal. Preferably, the attachment is connected proximate to the inner hub end 38 of the blade petal with the same fastening means used to connect the blade to the wing. The attachment has a rectangular back/trailing connection portion 52 which is connected to the blade petal and the wing. The attachment also has a lobe 54 from extending beyond a leading edge 44 of the blade petal. Thus, the lobe is the portion of the attachment that extends beyond the blade petal.

Each blade petal has a leading edge 44 and a trailing edge 46. The edges 44 and 46 may be straight edges which are parallel to one another on each blade and parallel to a radial line 29 passing centrally through the blade. The leading edge picks up air which is then accelerated across the fan blade to the trailing edge where a small amount of the air flows around the blade and a great majority of the air is forced forward to create air flow in the direction of arrow 28 in FIG. 1. Because of the high speeds and hence high stresses experienced at the outer free ends of the blades, the blades are normally manufactured from a strong material, usually a metal, which is able to withstand the stresses that are applied.

In the preferred embodiment shown in FIGS. 3 and 4, the lobe 54 extends from an inner trailing corner 58 of the back connector along an inner straight edge 60. The straight edge 60 is located closer to the center of the fan than the radially innermost point 62 of the blade petal and forms an acute angle $\alpha$ opening in the direction of rotation between the straight edge 60 and the radial line 29. Thus, the lobe 54 extends farther radially inward than any point on the blade petal 48, and a portion of the lobe is positioned inwardly from the innermost point 62 of the blade petal. The lobe 54 has a curved tip 64 which may be parabolic, hyperbolic, circular, elliptical, or any combination of these and other curves. Further, the lobe could be conical, rectangular, or some other shape. In the preferred embodiment, the curved edge of the tip 64 makes an approximately 180° change in direction back toward the back connector 52. The edge of the lobe then extends along a generally straight edge 66 until it connects at a curved radius 70 to a front/leading edge 68 of the back connector. Thus, the perimeter of the lobe is generally curved in shape and may have a parabolic or other shaped curve at the tip 64 of the lobe 54. The connection portion 52 is provided with three apertures 53 to receive the fasteners 36.

Referring again to FIGS. 1 and 2, the lobe 54 generally extends away from the leading edge 44 of the blade petal 48. Because the attachment is connected to the inner hub end 38 of the blade petal 48, the lobe 54 also extends forwardly beyond the leading edge of the inner hub end 38. The curved tip 64 of the lobe 54 is preferably positioned behind the inner hub end 38 of the trailing edge 46 of the preceding blade. Thus, each lobe 54 is slightly overlapped by the preceding blade corner 65 along the direction of air flow as illustrated by arrow 28. One blade precedes another with reference to the direction of rotation illustrated by arrow 26, so that the preceding blade is the adjacent blade in the direction of rotation. Thus, for blade 30A, the preceding blade is 30B. For blade 30B, the preceding blade is 30C, and for blade 30C, the preceding blade is 30A. Thus, the lobes and petals define a circular path 72 (shown in phantom) which is followed by the overlapping parts of the lobes and petals as the fan blades rotate.

A central opening 74, defined by the blades and through which the hub is visible, is generally triangular. The triangular opening 74 has its sides predominantly defined by the inner straight edges 60 of the lobes 54. Each lobe 54 is for the most part generally planar and occupies a plane common with the edge portion of the petal adjacent to the leading edge 44.

Because the attachment is located at the inner portion of the leading edge of the blade, it does not cover as much linear distance as the outer free end, and therefore, the attachment does not experience the same high stress as the outer free end of the blade. Because the attachment does not experience the same stress as the blade petal, the attachment is preferably made from a plastic material. The plastic material is less expensive and is more easily manufactured by, for example, injection molding into a myriad of shapes and configurations. Though it is preferred that the lobe be provided on a separate attachment, the overall blade configuration could be modified to include the lobe.

In operation, the motor, which is preferably electrically powered, rotates the impeller about its central axis. The fan blades move through the air, accelerating air in front of the fan to create the air flow in the direction of arrow 28. The acceleration of the air also creates an increase in pressure in front of the blades. The area behind the blades experiences a decrease in pressure into which air from the surrounding environment is drawn. As the blades continue to rotate, they continuously drive air away from the front of the blades and draw air to the rear of the blades thus creating air flow in the direction of arrow 28.

The blades do not impart equal acceleration and velocity to all of the air contacting the blades. Some air in fact passes over the trailing edge of the blade without being accelerated in the direction of arrow 28. With reference to the lobe of blade 30A and the preceding blade 30B, the lobe of blade 30A picks up air which has passed around the trailing edge of blade 30B. The lobe picks up this air, which has already been accelerated some, and further accelerates it. Therefore, the lobe takes advantage of the work already applied to the air passing over the trailing edge and applies further work to accelerating it.

Further, as the impeller continues to rotate, air accelerates toward the back of the fan from the surrounding environment. The highest velocity air is found directly behind the blade as the blade sweeps air out of an area to be filled by air from behind the fan. The lobe, by extending to a point behind the trailing edge of the preceding blade, picks up this high velocity air before it has a chance to significantly decelerate. Thus, the lobe takes advantage of the velocity of the air drawn into the back of the fan by the low pressure created behind the fan.

Some of the air being accelerated toward the back of the fan passes through the central opening 74 without being directly influenced by the blades. This air is accelerated by the pressure difference created by the fan and by the movement of surrounding air. As described, the lobes extend radially inward farther than the blade petals so that the area of the opening 74 is reduced by the lobes. By decreasing the area of the opening across which a pressure difference exists, the air passing through the central opening is accelerated further and thus increases the efficiency of the fan.

Thus, an attachment for connection to a fan blade is disclosed which utilizes a lobe protruding from a leading edge of the fan blade to increase the efficiency of the fan. While preferred embodiments and particular applications of this invention have been shown and described, it is apparent to those skilled in the art that many other modifications and applications of this invention are possible without departing from the inventive concepts herein. For example, an impeller utilizing any number of blades can be provided. If four blades are used, the shape of the central opening would be square. It is, therefore, to be understood that, within the scope of the appended claims, this invention may be practiced otherwise than as specifically described, and the invention is not to be restricted except in the spirit of the appended claims. Though some of the features of the invention may be claimed in dependency, each feature has merit if used independently.

What is claimed is:

1. A fluid circulation device comprising:

three blades, each blade having a leading edge;

each said blade having a lobe extending beyond the leading edge thereof, wherein said lobes define a triangular central opening.

2. The device according to claim 1 further comprising at least one attachment which includes the lobe and a back connection portion for connection to the at least one blade.

3. The device according to claim 1 wherein the lobe protrudes toward a preceding blade and at least part of the lobe protrudes inwardly from the blade petal to reduce the area of a central opening through the device.

4. The device according to claim 1 wherein the lobe protrudes from the leading edge near the inner hub end of the blade petal.

5. The device according to claim 1, wherein the lobe overlaps a trailing edge of an adjacent blade.

6. The device according to claim 1 wherein the lobe is rearward of the preceding blade.

7. The device according to claim 5 wherein each lobe overlapping the trailing edge of the adjacent blade defines a circular path.

8. An impeller blade comprising:

a blade petal having a leading edge, a trailing edge, an inner hub end, and an outer free end;

means for attaching the inner hub end to an impeller assembly;

a lobe extending beyond the leading edge wherein said lobe comprises a parabolic protrusion, an inner straight edge forming an acute angle a with a radial line of the blade petal, and the angle a opening in the direction of rotation.

9. The blade according to claim 8 wherein the lobe comprises an independent attachment attachable to the blade petal.

10. The blade according to claim 9 wherein the lobe is attachable to the inner hub end of the blade petal and comprises a plastic material.

11. The blade according to claim 8 wherein the lobe extends from the inner hub end of the leading edge.

12. The blade according to claim 8 wherein the lobe comprises a substantially planar contour.

13. An attachment for connection to an impeller blade petal having a leading edge and an inner hub end, the attachment comprising:

a back connection portion for connection to the blade petal;

a forward extending lobe connected with said connection portion for protruding beyond the leading edge of the blade petal wherein said lobe comprises a parabolic protrusion, an inner straight edge forming an acute angle a with a radial line of the blade petal and the angle a opening in the direction of rotation.

14. The attachment according to claim 13 wherein the back connection portion is arranged for connection to the inner hub end of the blade petal, and the forward extending lobe is arranged for protruding from the leading edge of the blade petal at the inner hub end thereof.

15. The attachment according to claim 13 wherein the back connection portion is arranged for connection to both the inner hub end of the blade petal and to a hub.

* * * * *